United States Patent [19]

Radcliffe

[11] 4,061,184

[45] Dec. 6, 1977

[54] HEAT EXCHANGER FOR A REFRIGERATED WATER COOLER

[75] Inventor: Richard J. Radcliffe, Gahanna, Ohio

[73] Assignee: EBCO Manufacturing Company, Columbus, Ohio

[21] Appl. No.: 736,506

[22] Filed: Oct. 28, 1976

[51] Int. Cl.[2] ..... F28D 7/10

[52] U.S. Cl. ..... 165/38; 62/394; 222/146 C; 165/156; 165/169; 29/157.3 V

[58] Field of Search ..... 165/104, 132, 155, 156, 165/163; 62/394, 395, 399; 222/146 C

[56] References Cited

U.S. PATENT DOCUMENTS

| | | | |
|---|---|---|---|
| 1,134,243 | 4/1915 | Strickler | 165/155 |
| 2,127,732 | 8/1938 | Heitman | 62/394 X |
| 2,856,760 | 10/1958 | Walter | 165/140 X |
| 3,482,625 | 12/1969 | Bray | 165/163 |

*Primary Examiner*—Albert W. Davis, Jr.

*Assistant Examiner*—Theophil W. Streule, Jr.

*Attorney, Agent, or Firm*—William S. Rambo

[57] ABSTRACT

A heat exchanger takes the form of a cylindrical tank having an inlet at one end to receive an influent liquid to be chilled, an outlet at the opposite end of the tank from which the chilled liquid may be discharged. A cooling coil is wrapped around the outer side wall of the tank for circulating a refrigerant in conductive, heat exchange relation to the tank. A cylindrical cup-shaped baffle is arranged coaxially within the tank for directing the influent liquid toward the side wall of the tank, and a pressure-expanded, helically wound conduit is positioned between and disposed in intimate heat exchange contact with both the side wall of the tank and the cup-shaped baffle and defines two relatively separated passages through which separate portions of the influent liquid pass to be chilled by contact with the tank, the baffle and the intervening helically wound conduit.

6 Claims, 6 Drawing Figures

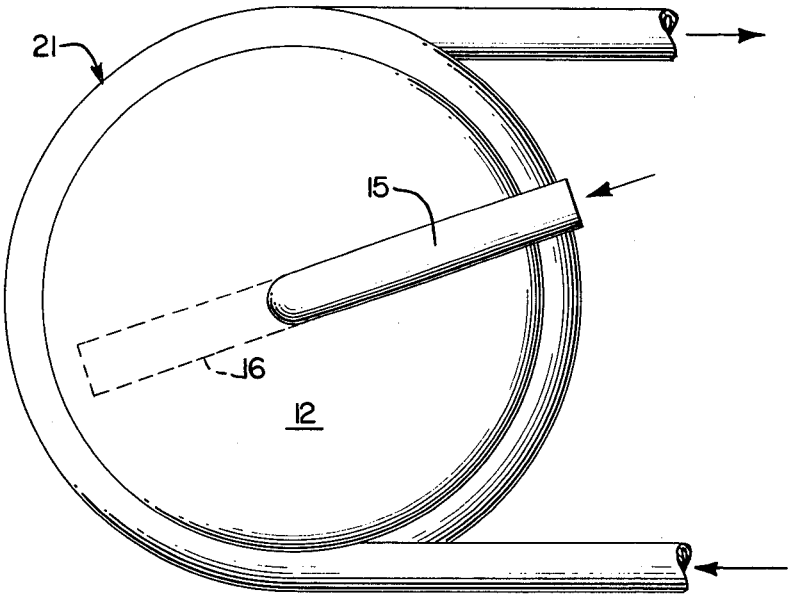
FIG. 3.
FIG. 4.
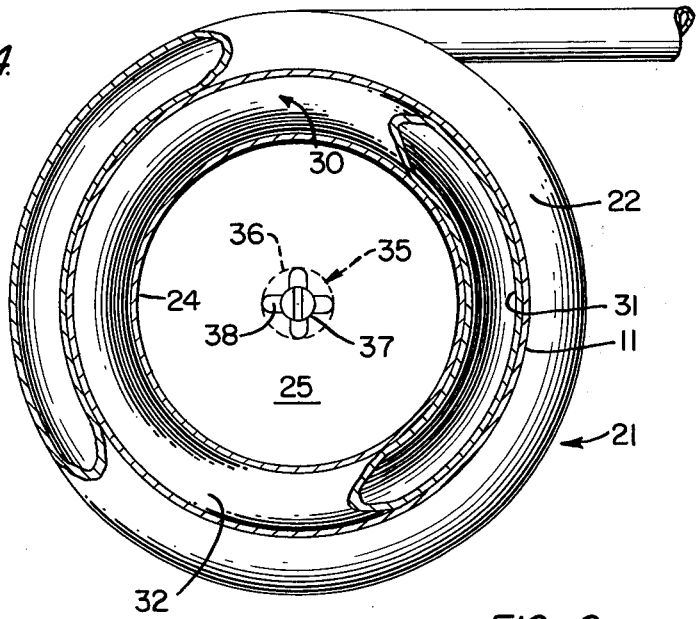
FIG. 5.
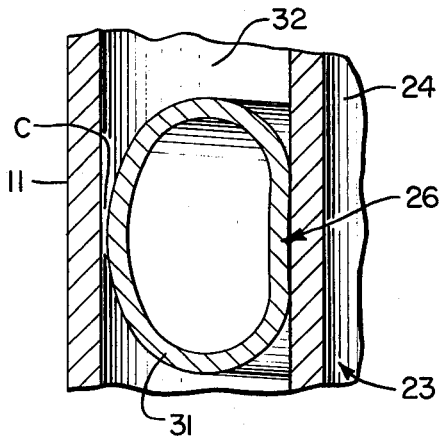
FIG. 6.
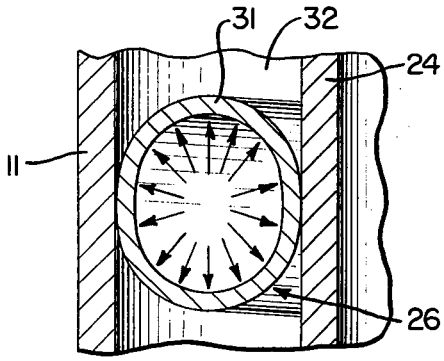

HEAT EXCHANGER FOR A REFRIGERATED WATER COOLER

BACKGROUND OF THE INVENTION

The present invention relates generally to heat exchangers, and more specifically to heat exchangers of the type used in refrigerated water coolers or the like for extracting heat from incoming drinking water by means of an evaporative refrigerant.

In the past, heat exchangers used in water coolers were generally of three types, namely the instantaneous type, the semi-instantaneous type, and the storage tank type. The instantaneous type heat exchanger comprises generally two fluid-conducting tubes disposed in intimate thermal contact with one another. One tube carries a low boiling point refrigerant, such as Freon, while the other tube conducts the water to be cooled. Instantaneous heat exchangers of this type, while being comparatively efficient for continuous flow applications, are not particularly suited for use in drinking water coolers because of their limited storage capacity and comparatively low thermal efficiency for intermittent flow applications.

Prior art semi-instantaneous-type exchangers typically comprise a relatively small volume metal receptacle or reservoir having a refrigerant evaporator (cooling) coil helically wrapped around and disposed in good thermal contact with its outer side wall, and a helical water-conducting coil bonded in good thermal contact with either the wall of the receptacle or the cooling coil and arranged to circulate influent drinking water therethrough and discharge the chilled water into the receptacle or reservoir. However, since the chilled water from the water-conducting coil is delivered to the lower portion of the receptacle and since the cooled water is drawn from the bottom of the receptacle upon opening of the bubbler valve or faucet of the water cooler, the main body of water which is stored in the receptacle remains substantially uncirculated and tends simply to act as a thermal flywheel. Thus, while the semi-instantaneous type heat exchanger is generally considered to be more efficient for use in refrigerated water coolers than the instantaneous type, it is generally larger, more expensive and requires more elaborate controls to prevent freeze-ups. The storage tank-type heat exchanger generally comprises a relatively larger volume metal tank or receptacle having a refrigerant evaporator or cooling coil wound around its outer side wall so as to cool the tank and water contained therein by conduction. Baffle means may be incorporated in the storage tank to promote thermal stratification of the water within the tank, thus keeping the coolest water toward the bottom of the tank from whence it is withdrawn upon opening of the bubbler valve or faucet of the water cooler. The storage tank-type heat exchanger has the advantages of a relatively larger storage capacity and, hence, the capability of providing a larger volume of chilled water for a short time interval, and also the ability to tolerate controlled ice formation along the inner surface of the tank. However, the storage tank-type heat exchanger is relatively bulky and has a comparatively low heat transfer coefficient under flow conditions due to the unconfined flow of water over the chilled surfaces of the tank. These characteristics tend to compromise the rated capacity of the water cooler for a given cabinet size.

SUMMARY AND OBJECTS OF THE INVENTION

The present invention provides an improved heat exchanger for a refrigerated water cooler or similar apparatus in which it is desired to transfer heat from one fluid medium to another. The present heat exchanger includes a comparatively small, compact tank or receptacle preferably composed of a metal or metallic alloy having a high coefficient of thermal conductivity and having an inlet at one end and an outlet at its opposite end. A refrigerant-circulating coil is wound about and disposed in intimate heat exchange contact with the outer side wall of the tank so as to cool the tank by conduction. An elongated, cup-shaped baffle is positioned coaxially within the tank and has a cylindrical side wall disposed in inwardly spaced, concentric relation to the inner side wall of the tank. The baffle is normally closed at one end thereof so that water passing from the inlet end of the tank to the outlet end thereof must flow through the annular space between the inner side wall of the tank and the cylindrical side wall of the baffle. A water-conducting metallic tube or pipe extends between the inlet and outlet ends of the tank and includes a helical coil portion disposed in the annular space between the baffle and tank and in pressure fitted thermal contact with both the inner side wall of the tank and the outer side wall of the baffle. The coils or convolutions of the water-conducting pipe are spaced relatively apart so that they define with the side walls of the tank and baffle a second, helical water-conducting passage which extends from the inlet end to the outlet end of the tank and which is separate from the water-conducting passage or bore within the pipe itself. The baffle is also provided with a pressure-relief valve which is operable in response to an ice blockage in and around the helical coil portion of the water-conducting pipe, and a consequent differential of pressures between the inlet and outlet ends of the tank, to temporarily open a by-pass through the baffle and thereby permit uninterrupted flow of water through the heat exchanger.

The principal object of this invention is to provide an improved heat exchanger which is more compact and thermally efficient than those heretofore used in refrigerated water coolers or the like, and one which admits of limited ice formation therein with attendant increased cooling through utilization of the latent heat of fusion of the ice, and with attendant savings by using less sensitive thermal controls and thus reducing the operating cycles of the associated refrigeration system.

Further objects and advantages will become more readily apparent by reference to the following description and the accompanying drawings.

BRIEF DESCRIPTION OF DRAWINGS

FIG. 3 is a top plan view of the heat exchanger;

FIG. 4 is a horizontal sectional view taken approximately along the line 4—4 of FIG. 1;

FIG. 5 is an exaggerated fragmentary vertical sectional view illustrating one of the convolutions of the water-conducting coil prior to its pressure expansion into contact with the inner wall of the heat exchanger tank, and FIG. 6 is a similar view illustrating diagramatically the pressure fitting of the water-conducting coil into thermal contact with the side wall of the tank.

DESCRIPTION OF PREFERRED EMBODIMENT

Figure 1:
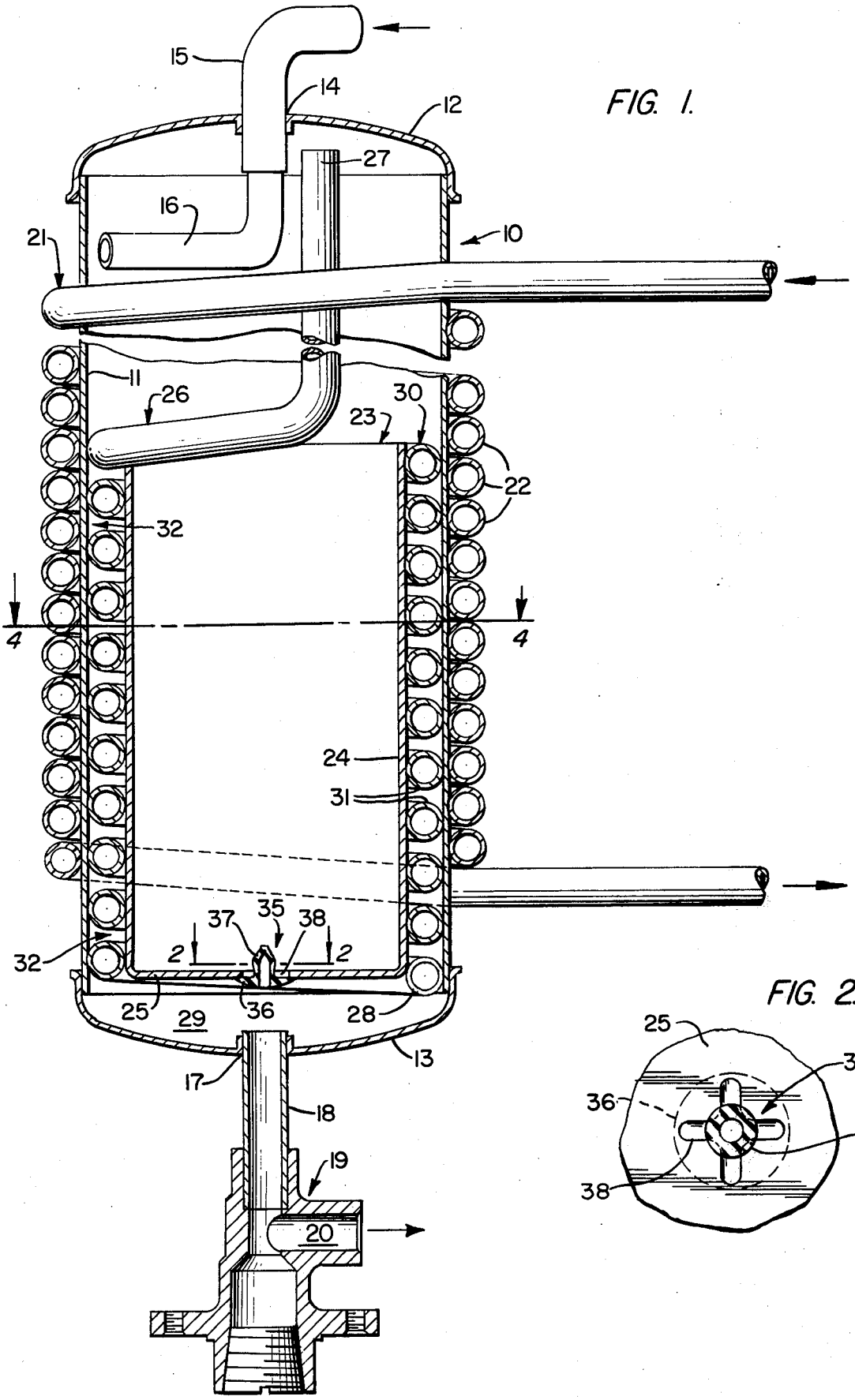
FIG. 1 is a vertical sectional view, partially in fragmented elevation, of a heat exchanger according to this invention.

Referring now to the drawings, and with particular reference to FIG. 1, it will be seen that the improved heat exchanger embodies a hollow receptacle or tank 10 which includes a cylindrical side wall 11 and opposite end closure caps 12 and 13 welded or otherwise secured in fluid-tight relation to the side wall 11. The end closure cap 12 is formed with a central inlet opening 14 in which is welded or otherwise received an L-shaped inlet conduit 15 through which fresh drinking water from a municipal main or other source (not shown) may be introduced into the tank 10. The inlet conduit 15 is preferably provided internally of the tank 10 with an elbow or right angular extension 16 which functions to direct the influent drinking water radially toward the side wall 11 of the tank rather than axially thereof to thereby minimize fluid turbulence which might otherwise interrupt or adversely disturb the thermal convection flow of liquid within the tank 10.

The opposite or lower end closure cap 13 is formed with a central outlet opening 17 in which is welded or otherwise fastened an outlet conduit or pipe 18 to which is connected a combined elbow and clean-out plug fitting 19. Following installation of the heat exchanger and in the operation thereof, the outlet passage 20 of the fitting 19 is normally connected by means of a remotely extending conduit (not shown) with the usual dispensing faucet or bubbler valve (not shown) of the water cooler.

The tank 10 is preferably formed from tinned copper, or other non-toxic, non-corrosive metal or metal alloy which possesses a high coefficient of thermal conductivity. Wound about the outer surface of the side wall 11 of the tank and disposed in intimate thermal contact therewith is a helical evaporator (cooling) coil 21 of a conventional compressor-type, liquid-gas refrigeration system, (not shown). The individual convolutions or turns 22 of the coil 21 are spaced very slightly apart from one another and are preferably soldered to the outer surface of the side wall 11 by hot dipping the assembly in a bath of molten tin or the like. The cooling coil 21 extends over the major portion of the length of the tank 10 and provides an efficient means for extracting heat from the tank and its contents.

Positioned coaxially within the tank 10 is a cup-shaped, sheet metal baffle 23 which includes a cylindrical side wall 24 disposed in inwardly spaced, concentric relation to the side wall 11 of the tank and an end closure wall 25 disposed in inwardly spaced relation to the end closure cap 13 of the tank. The cup-shaped baffle 23 is secured within the tank by means of a relatively soft and ductile metal tube or conduit 26 having an inlet end portion 27 opening into and communicating with the upper or inlet end of the tank 10, an outlet end portion 28 communicating with the outlet chamber 29 of the tank, and an intermediate, coiled portion 30 which is helically wound about the side wall 24 of the baffle and then pressure expanded into intimate heat exchange engagement with both the side wall 11 of the tank 10 as well as the side wall 24 of the baffle 23.

The baffle 23 and tube 26 are preferably formed as a sub-assembly before being installed in the tank 10. This is easily accomplished by using the baffle as a mandrel and winding the intermediate portion 30 of the tube in a helical coil around the outer surface of the side wall 24 of the baffle. As will be readily understood by those familiar with tube winding or coiling operations, when a copper or other relatively soft metal or conduit of circular cross section is wound tightly around a cylindrical surface, the tube is bent or flattened slightly into an oval shaped cross-section. Thus, by using a baffle 23 and tube 26 of predetermined outer diameters, a sub-assembly of these components may be slidably telescoped with minimal clearance within the side wall 11 of the tank before connecting the end closure caps 12 and 13 thereto. With the sub-assembly comprising the baffle 23 and conduit 26 properly indexed within the side wall 11 of the tank, the opposite ends 27 and 28 of the conduit 26 are connected with an hydraulic ram or pump (not shown) and the conduit is then subjected to an internal pressure (approximately 3000 psi) sufficient to expand the coils or convolutions 31 of the tube 26 into tight, intimate, thermal contact with both the side wall 11 of the tank 10 and the side wall 24 of the baffle. The pressure expansion of the coils 31 of the tube 26 into pressure fitting engagement with the side walls of the tank and baffle is illustrated (with slight exaggeration) in FIGS. 5 and 6. FIG. 5 shows the approximate flattened oval cross-sectional configuration of the coils or the convolutions 31 of the tube 26 which results from winding the tube around the side wall 24 of the baffle, and the clearance C between the inner surface of the side wall 11 of the tank and the coils 31 prior to the pressure expansion of the coils. FIG. 6 illustrates diagramatically the fluid pressure expansion of the coils 31 into tight-fitting heat exchange engagement with the side walls 11 and 24 of the tank and baffle, respectively, during which the coils 31 are actually diametrically expanded beyond the elastic limit of the metal from which they are formed. This diametric expansion of the coils 31 frictionally locks the same to the wall 11 of the tank 10 as well as to the side wall 24 of the baffle 23 and prevents any relative movement of the coils and baffle within the tank.

As will be noted in FIG. 1, the individual coils or convolutions 31 of the tube 26 are spaced relatively apart a distance sufficient to define with the outer surface of the baffle side wall 24 and the inner surface of the tank side wall 11 a spiral or helical passage 32 extending the full length of the baffle 23. The cross sectional area of the spiral passage 32 is preferably approximately equal to the cross sectional area of the bore of the tube 26, so that water introduced into the upper region of the tank will flow in two separate, but approximately equal volume, streams to the lower chamber 29 of the tank 10 upon opening of the outlet pipe 18 of the tank. In other words, the internal bore of the tube 26 defines a fluid passage between the upper inlet end portion of the tank which is separate and apart from the spiral passage 32 which is formed by the outer surfaces of the coiled portion of the tube 26 and the side walls 24 and 11 of the baffle 23 and tank 10, respectively.

Figure 2:
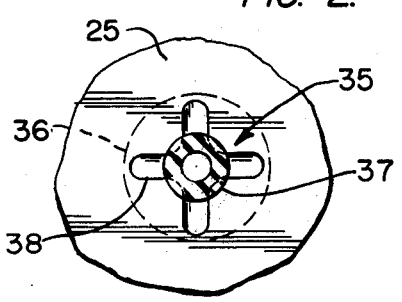
FIG. 2 is an enlarged, fragmentary horizontal sectional view taken along the line 2—2 of FIG. 1 and illustrating the ice-responsive pressure relief valve.

The end wall 25 of baffle 23 is provided with a poppet-type pressure relief valve generally indicated by reference numeral 35. The valve 35 comprises a resiliently flexible, grommet-shaped valve member having a diametrically enlarged head portion 36 and a hollow stem portion 37. The stem portion 37 is frictionally inserted through and retained in the relatively smaller diameter central portion of a cross-shaped (+) aperture or port 38 formed in the end wall 25 of the baffle. As seen particularly in FIG. 2, the enlarged head portion 36 of the valve member is disposed on the outlet side of the end wall 25 and normally overlies and closes the cross-shaped port 38. The valve 35 is operable in response to a differential in fluid pressure of approximately 7 psi between the inlet and outlet portions of the tank to open the cross-shaped port 38 and permit water to flow axially through the baffle 23 rather than around and through the intermediate coiled portion 30 of the tube 26 when the outlet pipe 18 is opened. Thus, if water flow through and around the coils 31 is temporarily interrupted by freezing and the outlet pipe is opened, the valve head 36 will be resiliently flexed or stretched, in response to the differential of pressures between the upper inlet end and the outlet chamber 29 of the tank, to open the valve port 38 and permit an axial by-pass flow of water through the baffle until the ice in and around the coils 31 is thawed by the relatively warmer water entering the tank.

OPERATION

In operation, the present heat exchanger is installed, preferably in a thermally insulated housing, so as to receive water under main pressure through the inlet pipe 15 and to dispense chilled water through the outlet pipe 18 and elbow fitting 19 upon opening of a relatively communicating faucet or bubbler valve (not shown) connected with the outlet 20. A conventional, thermostatically controlled compressor-type refrigerating system (also not shown) is connected to circulate evaporating refrigerant through the evaporator or cooling coils 21, preferably in response to the attainment of a predetermined elevated temperature at the coils 21. As the refrigerant evaporates in the coils 21, heat is extracted by conduction from the side wall 11 of the tank, the relatively contacting coils 32, and from the water contained in or passing through both the bore of the coiled portion of the tube 26 and the passage 32 around the outer surface of the coils 31 of the tube 26.

As will be apparent, the disposition of the inlet end 27 of the tube 26 at or near the top of the tank 10 facilitates the initial filling of the tank with water and the continued operation of the heat exchanger as a water-filled system, since air present in the lower regions of the tank, upon initial introduction of water therein from the top, will be displaced upwardly through the tube 26 and out through the inlet end 27 thereof until the water rises to or slightly above the level of the inlet 27 of the tube 26. Thus, the present heat exchanger will normally operate in a water filled condition, and as the outlet passage 20 is periodically opened by actuation of the associated faucet or bubbler valve, cold water will be drawn from the lower outlet chamber 29 and will be simultaneously replenished by an equal volume of relatively warmer water entering through the inlet pipe 15 into the upper inlet portion of the tank. The angular extension 16 of the inlet pipe 15 serves to direct the incoming, relatively warm water radially toward the side wall 11 of the tank, so that the desired thermal stratification of relatively warmer water in the upper region of the tank and colder water in the lower regions of the tank will not be disturbed greatly when cold water is withdrawn from the bottom of the tank.

The provision of the pressure relief by-pass valve 35 in the end wall 25 of the baffle 23 permits the heat exchanger to operate with limited ice formation in and around the coiled portion 30 of the tube 26. This greatly adds to the thermal efficiency of the heat exchanger by utilizing the latent heat of fusion of the ice upon thawing thereof to cool the water within the tank, and permits the associated refrigeration system to be operated less frequently and with less sensitive thermostatic controls with attendant savings in the costs of operation and equipment.

While the present heat exchanger finds particular utility as an integral part of a refrigerated water cooler, as particularly described herein, it should be understood that it may have many other and varied applications where it is generally desired to transfer heat efficiently from one fluid medium to another. Also, while a single preferred embodiment of the invention has been illustrated and described in detail, it will be obvious that various modifications as to details of constructin and design may be resorted to without departing from the spirit of the invention or the scope of the following claims.

I claim:

1. Apparatus for exchanging heat between two fluid mediums comprising:

a. a hollow metallic tank having a generally cylindrical outer side wall and opposite end walls, one of the end walls of said tank having an inlet through which a first fluid medium may be introduced into said tank, the other of said end walls having an outlet through which said first fluid medium may be discharged from said tank;

b. a baffle positioned within said tank and having an elongated generally cylindrical side wall disposed in inwardly spaced concentric relation to the side wall of said tank, and arranged normally to direct said first fluid medium toward the side wall of said tank during passage thereof through said tank;

c. a first tubular conduit positioned within said tank and having an inlet portion opening toward the inlet end of said tank, an outlet portion opening toward the outlet end of said tank, and an intermediate helical portion disposed between and in pressure-fitted heat exchange contact with each of the side walls of said baffle and said tank, said first conduit defining within itself a first passage for conducting a portion of said first fluid medium from the inlet to the outlet of said tank, the intermediate helical portion of said conduit having relatively spaced apart convolutions defining with the side walls of said baffle and said tank a second, relatively separated, spiral passage for conducting another portion of said first fluid medium from the inlet to the outlet of said tank; and d. a second tubular conduit helically wound about and disposed in heat exchange contact with the outer surface of the side wall of said tank for conducting a second fluid medium in heat exchange relation to the outer side wall of said tank.

2. Apparatus according to claim 1, wherein the inlet of said tank includes an angular extension for directing said first fluid medium radially toward the side wall of said tank.

3. Apparatus according to claim 1, wherein said baffle includes a pressure-responsive valve operable in response to a given differential of pressures at the inlet and outlet ends of said tank to open said baffle for the axial flow of fluid therethrough.

4. Apparatus according to claim 1, wherein the axis of said tank is substantially vertical, and the inlet portion of said first tubular conduit extends substantially to the uppermost region of said tank.

5. Apparatus according to claim 1, wherein said baffle comprises a generally cylindrical, cup-shaped metal shell having a closed end adjacent the outlet of said tank and an open end adjacent the inlet of said tank, and a normally closed pressure-responsive valve carried by the closed end of said shell.

6. In a heat exchanger which includes a metallic tank having a generally cylindrical outer side wall, an inlet communicating with one end of said tank, an outlet communicating with the opposite end thereof, and a first tubular conduit helically wrapped about and disposed in heat-exchange contact with the outer side wall of said tank for conducting a first fluid medium in heat exchange relation to said tank; that improvement which comprises:

a. a baffle member positioned coaxially within said tank and having a cylindrical side wall disposed in inwardly spaced concentric relation to the side wall of said tank and defining therewith an axially elongated, annular passage between the inlet and outlet of said tank; and b. a second tubular conduit having a first end portion in fluid communication with the inlet of said tank, a second end portion in fluid communication with the outlet of said tank, and an intermediate helical portion positioned in the annular space between the side wall of said baffle member and the side wall of said tank, the helical portion of said second conduit having relatively spaced apart convolutions disposed in pressure-fitted heat exchange contact with the side walls of said baffle member and said tank and defining therewith a spiral passage having opposite ends in fluid communication with the inlet and outlet of said tank, respectively; said second conduit and said spiral passage providing two, relatively separated passageways for the flow of a second fluid medium between the inlet and outlet of said tank.

* * * * *